US005676999A

United States Patent [19]

Silva

[11] Patent Number: 5,676,999

[45] Date of Patent: Oct. 14, 1997

[54] TOOL AND METHOD FOR APPLYING A TEXTURE SLURRY TO A SURFACE OF DRYWALL

[76] Inventor: Gilbert E. Silva, Rte. 1, Box 134, Kittrell, N.C. 27544

[21] Appl. No.: 463,197

[22] Filed: Jun. 5, 1995

[51] Int. Cl.[6] ..... B05D 1/32; B05D 3/12; B05C 1/00; E04G 23/02

[52] U.S. Cl. ..... 427/140; 427/271; 427/280; 427/282; 427/356; 118/211; 52/514; 264/36

[58] Field of Search ..... 427/140, 267, 427/271, 274, 280, 356, 272, 282; 52/514, 514.5, 742.13; 264/36; 118/211

[56] References Cited

U.S. PATENT DOCUMENTS

| | | | |
|---|---|---|---|
| 333,459 | 12/1885 | Gibson | 427/282 |
| 4,707,391 | 11/1987 | Hoffmann, Sr. | 428/63 |
| 5,196,263 | 3/1993 | Melby et al. | 428/327 |
| 5,203,507 | 4/1993 | Matthews | 239/373 |
| 5,447,752 | 9/1995 | Cobb | 427/270 |

*Primary Examiner*—Shrive Beck
*Assistant Examiner*—Fred J. Parker
*Attorney, Agent, or Firm*—Robert Charles Hill

[57] ABSTRACT

A tool and method for applying a texture slurry to a surface is provided. The tool comprises a flat, rectangular body for mating to a smooth surface, such as a repaired portion of drywall. The body has a multiplicity of spatially positioned openings disposed therethrough. Each of the openings has a predetermined configuration and position on the tool, for providing a pattern substantially matching the appearance of existing textured surface adjacent to the smooth surface. The invented method includes first affixing the tool to the smooth area of the surface, then applying a texture slurry to the tool. The spatially positioned openings receive the slurry to apply the slurry to the smooth surface for forming a newly textured area. The spatially positioned openings in the tool enable a user to substantially match the appearance of the newly textured area, with the appearance of the existing adjacent textured surface. After the slurry is applied to the tool, the tool is removed and a trowel is lightly dram across the newly textured area, until the appearance of the newly textured area closely matches the appearance of the textured surface.

10 Claims, 4 Drawing Sheets

TOOL AND METHOD FOR APPLYING A TEXTURE SLURRY TO A SURFACE OF DRYWALL

BACKGROUND OF THE INVENTION

1. Field of the Invention

The present invention relates generally to devices used to apply a texture slurry to a surface, such as an interior wall, and more particularly, to an improved tool and method for applying a texture slurry to a surface that enables a user to substantially match the appearance of the newly applied texture with the appearance of an existing adjacent textured surface.

2. Description of Related Art

It is well known to apply a desired texture slurry to a wall surface, such as gypsum wallboard, commonly referred to as sheetrock or drywall. The texture slurry, known as texture, typically comprises a slurry of gypsum, suitable sands, and water. The mount of sand and water may be altered for changing the consistency of the slurry. A thicker slurry results in rough texture on the drywall, while a thin slurry results in a somewhat smooth texture on the drywall. After the slurry is applied to the drywall, the slurry dries to achieve the desired texture. The texture is applied to the drywall to enhance the appearance of the wall or to hide surface imperfections.

A number of known methods and tools are used to apply the texture slurry to the drywall. One of the more common methods for applying the slurry to the drywall comprises, first preparing a slurry having the desired viscosity. Then a tool, such as a trowel, is operated by hand and used to apply the texture slurry to the drywall. The slurry is spread about the drywall until the desired appearance is achieved. It is a known difficulty of applying the slurry to drywall when there is existing texture adjacent to an area to be textured. If there is existing texture adjacent to the area to be textured, such as a repaired portion of drywall for example, it is extremely difficult to match the newly textured area to the existing texture, due the difficulty of achieving the desired viscosity of the slurry.

A prior art automated mechanism for applying a material slurry, such as a texture slurry to a substrate such as drywall is disclosed in U.S. Pat. No. 5,203,507, to Matthews. The disclosed mechanism comprises an air powered sprayer that includes a canister assembly. A piston assembly is disposed in the canister and reciprocates along the length of the canister. An air inlet is disposed at one end of the piston canister assembly. At an opposite end, a slurry inlet and outlet device is provided. A nozzle assembly is coupled to the slurry outlet for passing of the slurry material for subsequent combination with air at the nozzle assembly. The combination of slurry material and air are then disposed on the surface to be treated. A disadvantage of the disclosed mechanism is that it is not particularly well suited for application of texture to a relatively small surface area, such as during repair work.

U.S. Pat. No. 5,196,263, to Melby et al., discloses a rubber article having a textured surface and a method for preparing the rubber article. The disclosed texture coating mixture is formed from a mixture of a rubber composition having a rubber component and rubber particles, substantially the same as the rubber composition employed to form the rubber article. A method of forming the rubber article is also provided which includes coating the rubber article with such a rubber texture coating mixture.

Although the devices disclosed in the above prior art references have improved features, they fall to disclose all of the advantageous features achieved by the present invention.

There, therefore exists a need for an improved tool and method for applying a texture slurry to a surface that is facile to use and enables a user to substantially match the appearance of the newly applied texture with the appearance of an existing adjacent textured surface.

OBJECTS OF THE INVENTION

It is therefore an object of the present invention to provide an improved tool and method for applying a texture slurry to a surface that enables a user to substantially match the appearance of newly applied texture with the appearance of an existing adjacent textured surface;

It is another object of the present invention to provide an improved tool and method for applying a texture slurry to a repaired drywall surface that enables a user to substantially match the appearance of newly applied texture with the appearance of an existing adjacent textured drywall surface;

It is another object of the present invention to provide an improved tool for applying a texture slurry to a repaired surface that enables a user to substantially match the appearance of newly applied texture on the repaired surface with the appearance of existing texture adjacent to the repaired surface that is facile to use; and It is a further object of the present invention to provide an improved tool and method for applying a texture slurry to a repaired surface that enables a user to substantially match the appearance of newly applied texture on the repaired surface with the appearance of the existing texture adjacent to the repaired surface that is well suited for application of texture to a relatively small surface area.

SUMMARY OF THE INVENTION

These and other objects and advantages of the present invention are achieved by providing an improved tool and method for applying a texture slurry to a repaired surface. The invented tool and method enables a user to substantially match the appearance of newly applied texture to the appearance of the existing texture adjacent the repaired surface. The tool of the present invention is well suited for applying texture to a relatively small area, such as a repaired portion of drywall, for example.

The tool comprises a flat, rectangular body for mating to the smooth surface. The body has a multiplicity of spatially positioned openings disposed therethrough. Each of the openings has a predetermined configuration and position on the body such that when the slurry is applied to the tool, a predetermined amount is disposed through the openings in the tool and onto the smooth drywall in a predetermined pattern to form a newly textured area on the drywall.

In a first embodiment, the openings are circular and have different predetermined diameters. In alternative embodiments, each of the openings has a different predetermined anomalous periphery and dimension, for enabling a predetermined amount of the slurry to be disposed therethrough and onto the drywall in a desired pattern. Thus, the openings in the embodiments of the invented tool enable texture that is newly applied to the drywall, through the tool, to form a pattern on the drywall that substantially matches the appearance of existing texture adjacent to the newly textured area.

The invented tool has a preferred thickness ranging from approximately 20 to approximately 26 thousandths inch thick. The thickness of the tool inhibits an excessive amount of the slurry from being applied to the drywall. Further, in the preferred embodiment, the tool is fabricated from a biodegradable material, such as paperboard. Therefore, the tool can be disposed of without causing harm to the environment.

The invented method of applying the texture slurry to a smooth area, such a repaired portion of drywall surrounded by existing texture, comprises first selecting an embodiment of the tool that most closely matches the appearance of the existing texture on the drywall. The tool is then affixed to the smooth area. A suitable means for affixing the tool to the drywall may be masking tape, for example. The texture slurry is then applied over the tool. A preferable quantity of the slurry, would be sufficient to fill the openings, without the slurry extending out of the openings and substantially covering the tool.

The invented tool is then removed from the surface to reveal a newly textured area, with the appearance of the newly textured area matching the appearance of the existing texture. A trowel, if desired, is then drawn across the newly textured area until the appearance of the newly textured area closely matches the appearance of the textured surface. After the newly textured area is dry, paint may then be applied to the newly textured area, to sufficiently match the existing finish on the adjacent textured surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein.

Figure 1:
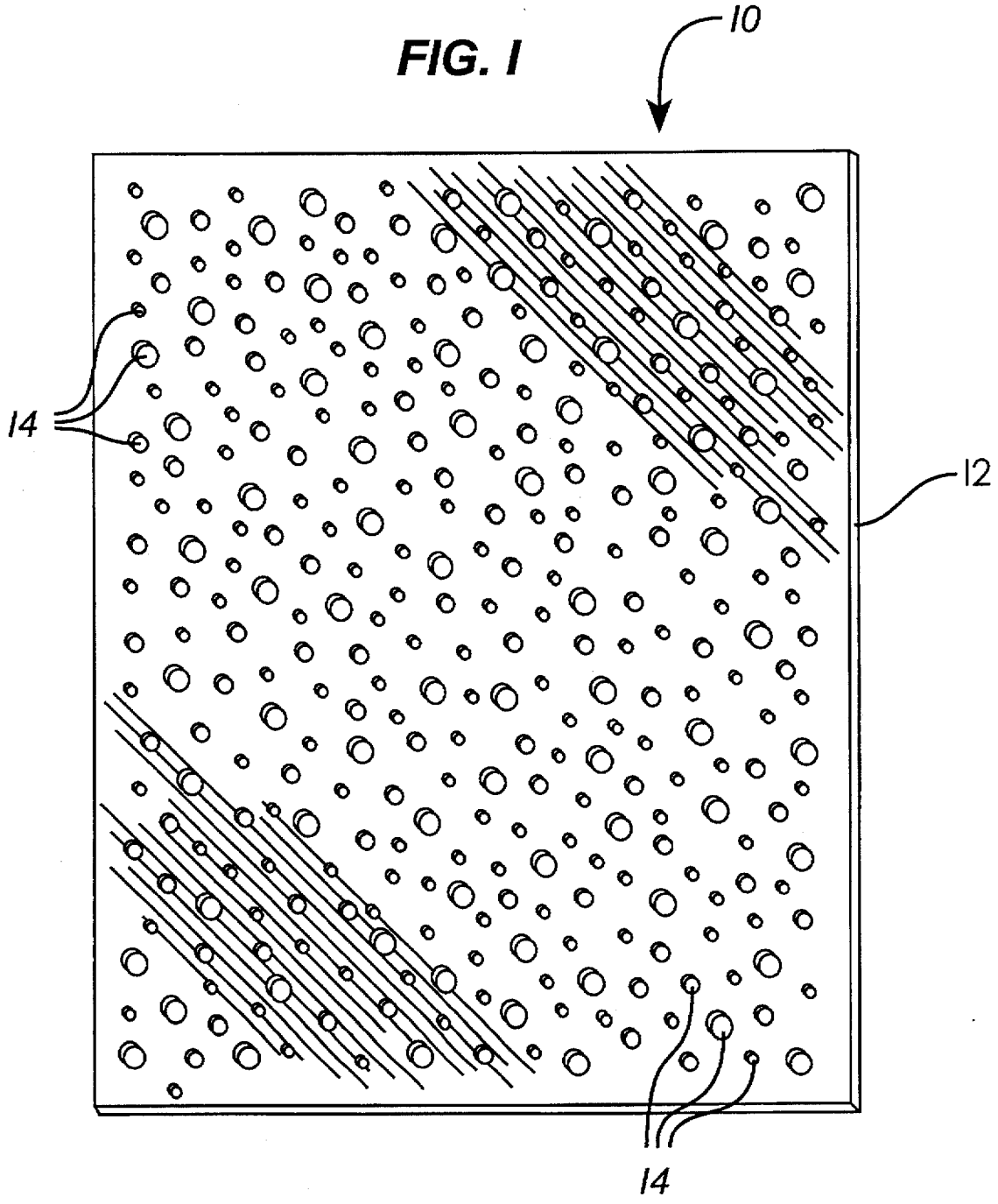
FIG. 1 is a plan schematic view of an embodiment of the tool of the present invention.

Referring now to FIG. 1 of the drawings, there is shown an embodiment of a tool 10 for applying a texture slurry to a smooth portion of a textured surface (both not shown). The invented tool 10 comprises a flat body 12 that is preferably rectangular, and is 11 inches long and 8.5 inches wide. Preferably, the tool 10 ranges in thickness from approximately 20 to approximately 26 thousandths inch thick. The invented tool 10 may be fabricated from any of several well known materials, such as a suitable biodegradable paperboard for example. The tool 10 is flat for mating to a smooth surface, such as a repaired portion of sheetrock or drywall.

The body 12 has a multiplicity of spatially positioned openings 14 disposed therethrough. In the embodiment shown in FIG. 1, each of the openings 14 is substantially circular and is positioned on the body 12, such that when the slurry is applied to the tool 10, a predetermined amount of the slurry is disposed through the openings 14 in the tool 10 and onto the repaired portion of drywall in a pattern determined by the openings 14. The circular openings 14 are shown having different predetermined diameters, to achieve the desired texture pattern on the drywall.

Figure 2:
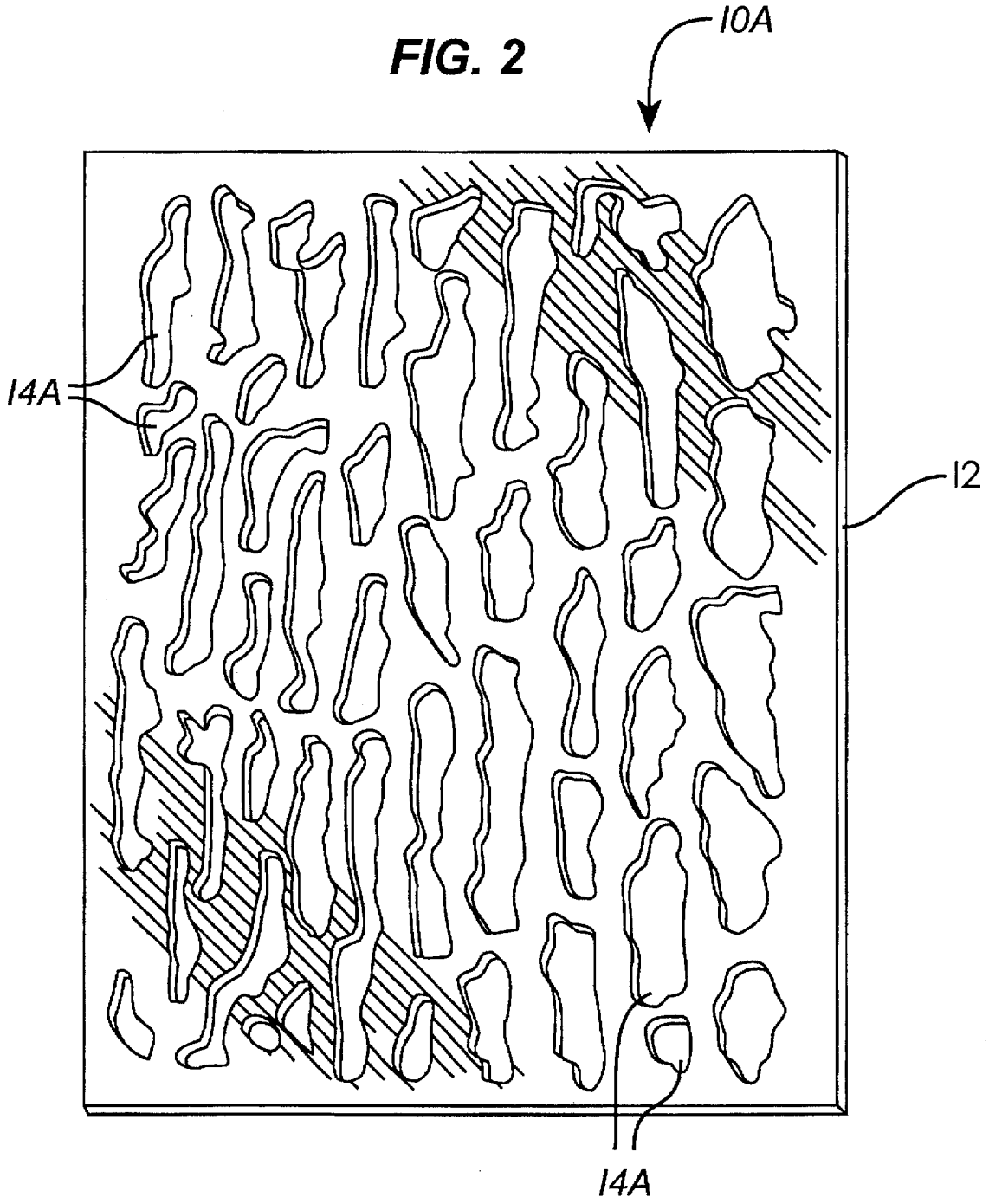
FIG. 2 is a plan schematic view of a first alternative embodiment of the tool of the present invention.
Figure 3:
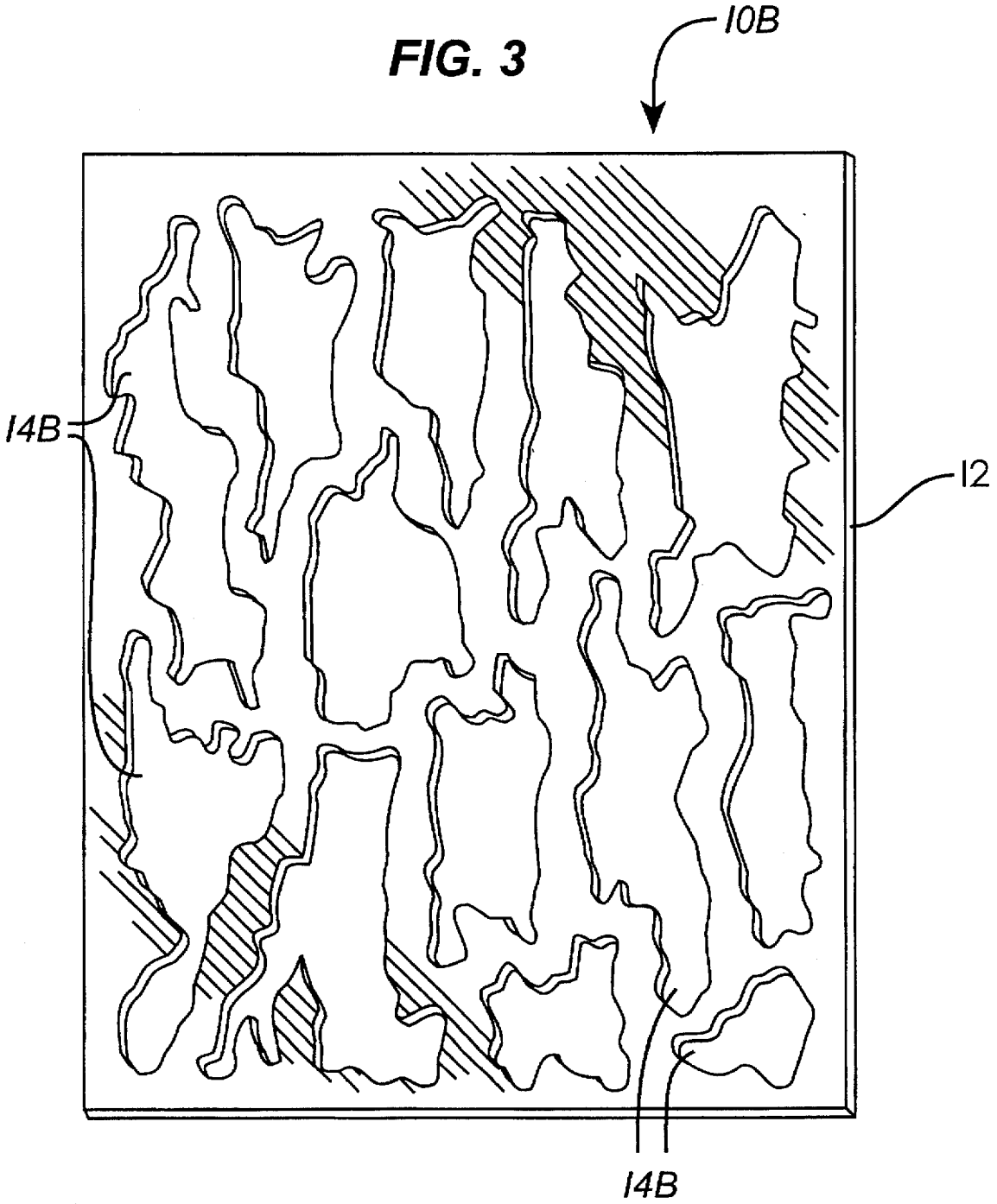
FIG. 3 is a plan schematic view of a second alternative embodiment of the tool of the present invention.
Figure 4:
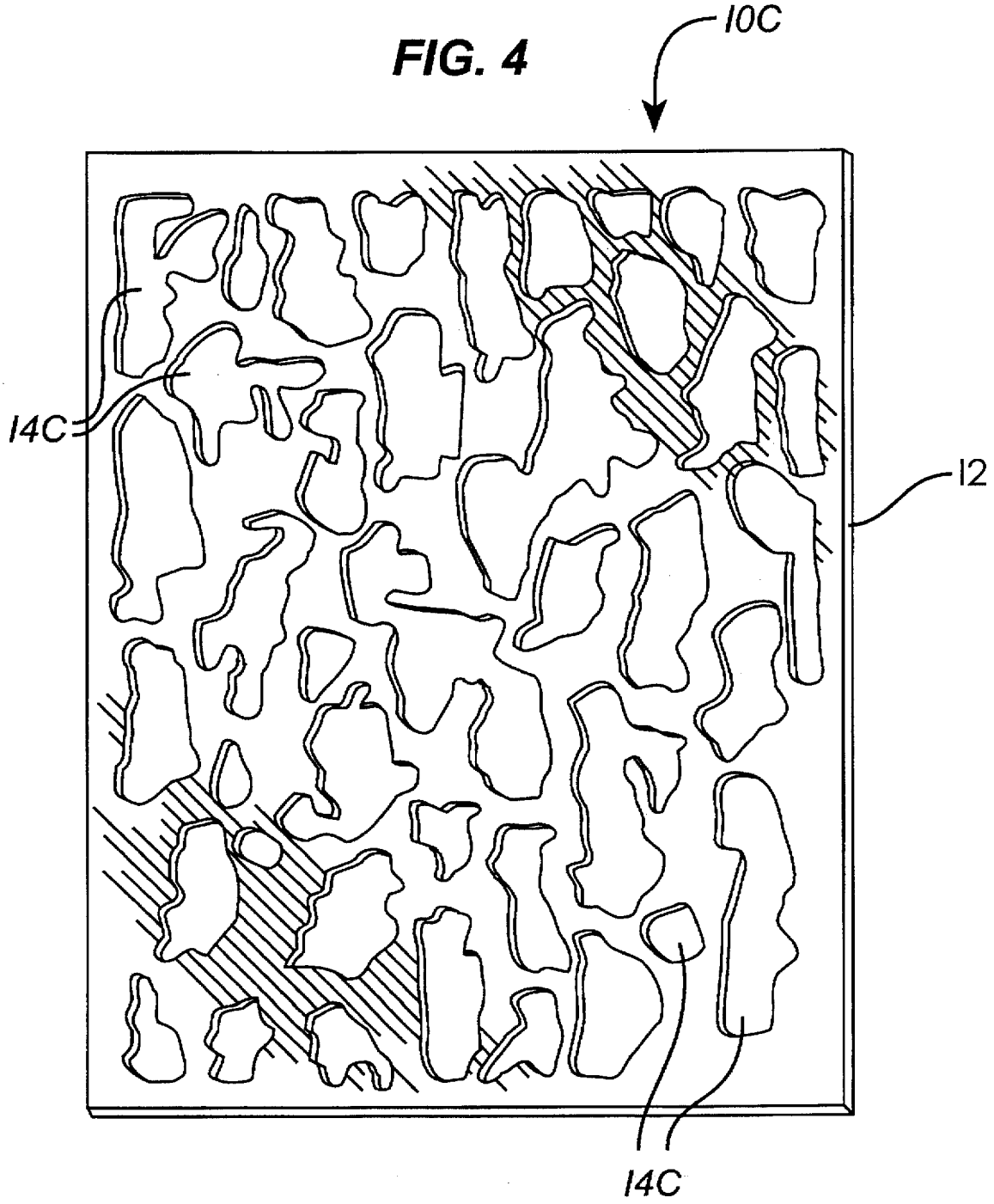
FIG. 4 is a plan schematic view of a third alternative embodiment of the tool of the present invention.

Referring now to FIGS. 2–4 of the drawings, alternative embodiments of the invented tool 10A, 10B, 10C, respectively, are shown. In each of the alternative embodiments 10A, 10B, 10C, the body 12 has openings 14A, 14B, 14C, with different predetermined anomalous peripheries and dimensions. The configuration, dimensions, and positioning of the openings 14A, 14B, 14C, was achieved using empirical data. A first alternative embodiment 10A, shown in FIG. 2, is provided with a plurality of openings 14A that are substantially narrow and somewhat elongated. FIG. 3 shows a second alternative embodiment 10B, which is provided with a plurality of openings 14B to provide a texture pattern that is longer and wider than the texture pattern provided by the first alternative embodiment 10A. A third alternative embodiment 10C, shown in FIG. 4, is configured with a plurality of openings 14C that provide a somewhat anomalous texture pattern. The embodiments of the invented tool 10, 10A, 10B, 10C, provide different texture patterns that substantially match the appearance of an existing textured area (not shown) adjacent to the repaired area.

To use the tool 10 of the present invention, an area to be textured, such as a smooth portion of repaired drywall, is located. The adjacent existing textured area is then surveyed, and the appropriate embodiment of the invented tool 10, 10A, 10B, 10C, that most closely matches the appearance of the existing texture is selected. The tool 10 is affixed to the drywall using known means, such as masking tape for example, which will not harm the tool 10 or drywall.

A texture slurry is then provided. The texture slurry may comprise desired quantities of gypsum and water, for example. The ratios of gypsum and water in the slurry are usually altered for changing the consistency of the slurry. It is extremely difficult in the prior art to match the consistency of the texture slurry with the perceived consistency of the existing texture. A factor that contributes to the difficulty in matching the consistency of the slurry, to the existing texture, are the ratios of gypsum and water in the slurry. Using the invented tool 10, a texture slurry of moderate consistency may be used to match existing texture of various consistencies.

The slurry is then disposed over the tool, with an appropriate hand tool such as a trowel or joint knife. A sufficient quantity of the slurry is disposed over the tool 10, such that the slurry fills the openings 14 in the tool 10 without the slurry extending out of the openings 14 and substantially covering the tool 10. The preferred thickness of the invented tool 10 inhibits an excessive, or insufficient, amount of texture from being applied to the surface.

The tool 10 is then removed from the drywall to expose a newly textured area formed adjacent to the existing textured surface. If the newly textured area does not sufficiently match the existing textured surface, the trowel may be lightly drawn across the newly textured area until the appearance of the newly textured area closely matches the appearance of the textured surface. After the newly textured area is dry, paint may then be applied to the newly textured area, to sufficiently match the existing finish on the adjacent textured surface.

Thus, there has been described an improved tool and method for applying a texture slurry to a repaired surface, that enables the user to substantially match the appearance of the newly textured area with the appearance of the existing texture adjacent the repaired surface. The tool of the present invention is well suited for applying texture to a relatively small area, such as a repaired portion of drywall. The tool has a flat body for mating to the drywall. The body has a multiplicity of spatially positioned openings, each with a predetermined configuration and position on the body, for applying a predetermined amount of the slurry, in a predetermined pattern, onto the drywall to form a newly textured area. The thickness of the tool provides for an appropriate amount of the slurry to be applied to the drywall. In the preferred embodiment, the invented tool is fabricated from a biodegradable material, such as paperboard. Therefore, the tool of the present invention can be disposed of without causing harm to the environment.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A tool for applying a texture slurry to a smooth portion of (a) an existing textured surface of drywall comprising:

a flat body for mating to said smooth portion, said body having a thickness and having a multiplicity of spatially positioned openings disposed therethrough, each of said openings configured and positioned on said body, such that when the texture slurry is applied to said tool, a sufficient amount of the texture slurry is disposed through the openings in said tool and onto the smooth portion in a pattern to form a newly textured area on the smooth portion having an appearance substantially similar to the appearance of an adjacent portion of the existing textured surface, the amount of texture slurry disposed through the openings determined by the configuration of the openings and the thickness of the body.

2. The tool of claim 1 wherein said openings are circular and said openings have diameters to substantially reproduce the appearance of the adjacent portion of the existing textured surface.

3. The tool of claim 1 wherein each of said openings has a different irregular periphery and is dimensioned for enabling a sufficient amount of the texture slurry to be disposed therethrough and onto said surface in a pattern to form a newly textured area having an appearance on the surface substantially similar to the appearance of the adjacent portion of the existing textured surface.

4. The tool of claim 1 wherein said tool comprises a substantially rigid material.

5. The tool of claim 1 wherein said tool comprises a substantially rigid biodegradable material.

6. The tool of claim 5 wherein said biodegradable material comprises paperboard.

7. The tool of claim 1 wherein said tool ranges in thickness from approximately 20 thousandths inch to approximately 26 thousandths inch.

8. In an existing textured surface having a smooth area surrounded by the existing textured surface of drywall, an improved method for applying a texture slurry to the smooth surface that enables a user to substantially match the appearance of newly applied texture to the smooth surface with the appearance of the existing adjacent textured surface, said method comprising the steps of:

selecting a tool having a multiplicity of spatially positioned openings disposed therethrough, each of said openings having a configuration and position on said tool for providing a pattern substantially matching the appearance of the existing adjacent textured surface;

affixing said tool to the smooth area of said surface such that said tool covers at least a desired portion of the smooth area;

providing a desired texture slurry;

disposing the texture slurry over said tool for forming a newly textured area, a sufficient quantity of the texture slurry being disposed over said tool such that the texture slurry fills the openings in said tool without the texture slurry extending out of the openings and without substantially covering said tool;

removing said tool from the newly textured area to expose the newly textured area formed adjacent to the existing textured surface; and drawing a trowel across the newly textured area until the appearance of the newly textured area closely matches the appearance of the existing textured surface adjacent to the newly textured area.

9. The method of claim 8 wherein the openings in said tool are circular and have different diameters determined by the amount of slurry to be disposed therethrough to match the appearance existing adjacent textured surface.

10. The method of claim 8 wherein each of the openings in said tool has a different irregular periphery and is dimensioned to match the appearance of the existing adjacent textured surface.

* * * * *